United States Patent [19]

Cain

[11] 3,952,341

[45] Apr. 27, 1976

[54] METHOD AND DEVICE FOR CLEARING A STOPPED UP DRAIN

[76] Inventor: James F. Cain, 1221 Velma Court, Youngstown, Ohio 44512

[22] Filed: Apr. 18, 1975

[21] Appl. No.: 569,538

[52] U.S. Cl. ..... 4/255; 222/215

[51] Int. Cl.[2] ..... E03D 11/00

[58] Field of Search ..... 4/255, 256, 257; 222/215; 141/285, 311; 206/218; 215/1; 150/.5

[56] References Cited

UNITED STATES PATENTS

| | | | |
|---|---|---|---|
| 2,714,898 | 8/1955 | Reese | 141/311 X |
| 2,733,450 | 2/1956 | Wallace | 4/256 |
| 3,266,532 | 8/1966 | Stewart | 141/285 X |
| 3,434,589 | 3/1969 | Lindstorm et al. | 206/218 |
| 3,474,844 | 10/1969 | Valtri et al. | 150/.5 |
| 3,480,021 | 11/1969 | Ewald | 134/24 |
| 3,644,943 | 2/1972 | Leonardo et al. | 4/255 |
| 3,823,427 | 7/1974 | Pittet | 4/255 |

*Primary Examiner*—Henry K. Artis
*Attorney, Agent, or Firm*—Webster B. Harpman

[57] ABSTRACT

A device comprising a collapsible container having a throat configuration registrable with a drain opening and a frangible seal acting to open when the collapsible container is collapsed as in directing the caustic contents thereof into a stopped up drain.

6 Claims, 2 Drawing Figures

METHOD AND DEVICE FOR CLEARING A STOPPED UP DRAIN

BACKGROUND OF THE INVENTION

1. Field of the Invention:

This invention relates to means for opening stopped up drains and the like.

2. Description of the Prior Art:

Prior methods and devices for opening stopped up drains have comprised three general proposals. First the introduction of a mechanical element into the drain so as to forcefully move or remove the stoppage. Two, the attempted introduction of a caustic material into the stopped up drain by pouring the same thereinto and three, the introduction of pressure both hydraulic and pneumatic so as to forcefully remove the stoppage.

The invention combines the best features of the prior art and introduces device for applying hydraulic and pneumatic pressure to the stopped up drain together with a charge of a caustic material which is injected thereby into the area of the stoppage by a device containing the caustic material and collapsible when in registry with the drain opening to create the hydraulic and pneumatic and injecting pressures necessary.

SUMMARY OF THE INVENTION

A device for clearing a stopped up drain is disclosed in which hydraulic and pneumatic pressure along with an injected charge of a caustic material are introduced into a stopped up drain through a drain opening communicating therewith by a collapsible container for the caustic material and acting as a pressure generating unit when manually collapsed while in registry with the drain opening.

DESCRIPTION OF THE PREFERRED EMBODIMENT

Figure 1:
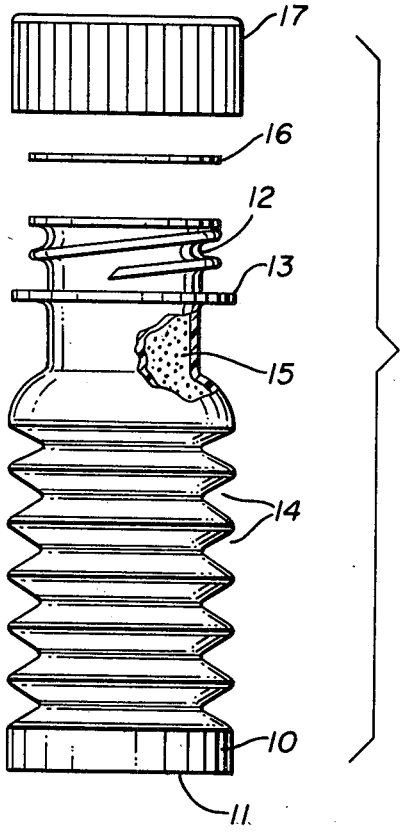
FIG. 1 is an exploded side elevation of a collapsible caustic container and dual closures therefor with parts broken away and parts in cross section.

In its simplest form the device for clearing a stopped up drain comprise uses the forceful introduction of a caustic agent such as lye into a drain opening along with a pressure surge, both hydraulic and pneumatic and the device comprises a collapsible container 10 preferably cylindrical having a closed bottom end 11 and an exteriorly threaded throat 12. A relatively wide annular collar 13 is formed exteriorly of the throat 12 and the body of the container 10 between the throat 12 and the closed lower end 11 takes the form of a plurality of bellow-like collapsible sections 14.

The body 10 of the container is formed of a flexible resilient synthetic resin such as polypropelene or the like and as illustrated in FIG. 1 of the drawings is normally filled with a caustic compound 15 such as lye in powder or flake form. A first sealing disc 16 preferably of aluminum, is sealed at its peripheral edge to the upper end of the throat 12 and a second closure comprising a threaded cap 17 is positioned thereover and engaged on the threaded throat 12 to form a satisfactory package for the caustic material.

It will thus be seen that a container for a caustic material such as lye has been disclosed which is doubly sealed so as to be safe in handling.

Figure 2:
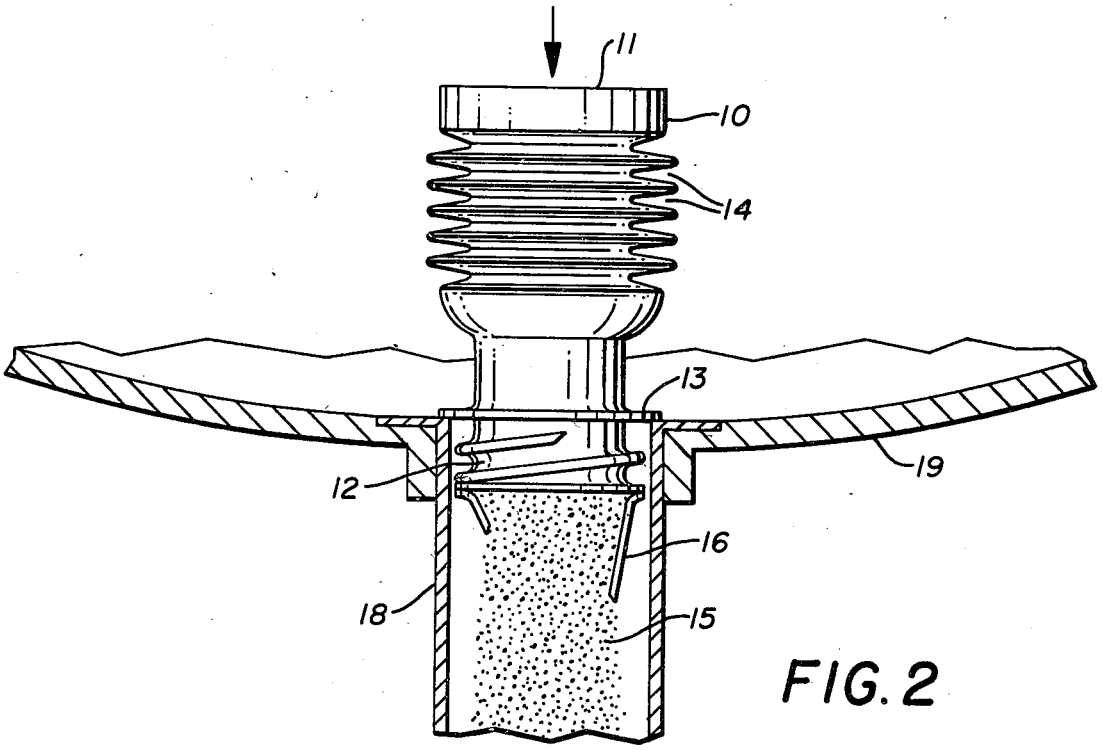
FIG. 2 is a vertical section through a portion of a drain opening illustrating the force generating and material injecting action of the collapsible container of the invention.

By referring now to FIG. 2 of the drawings, it will be seen that the container and the caustic material therein are shown in use in the herein disclosed method of clearing a stopped up drain and wherein a drain pipe 18 is shown in communication with a sink 19 or the like and the container 10 is shown inverted and positioned with its threaded throat 12 partially within the drain pipe 18 and the relatively wide collar 13 forming a closure with respect to the open end of the drain pipe 18.

In FIG. 2 of the drawings the container 10 will be seen to have been largely collapsed by force directed against its inverted bottom 11 as by the hand of the user so that the bellows-like sections 14 of the body 10 are collapsed to the point where the caustic material 15 has been forced through the aluminum sealing disc 16 which is broken and injected into the drain along with the caustic material where it is consumed thereby as the caustic material 15 reacts with and dissolves the stoppage blocking the drain pipe 18.

In addition to the introduction of the caustic material 15 the action of collapsing the container 10 as shown in FIG. 2 applies a hydraulic and pneumatic pressure surge to the stopped up drain pipe 18 with the combined result that the caustic material is injected into the area of the stoppage and the drain opened thereby.

It will thus be seen that a device for clearing a stopped up drain has been disclosed which may be inexpensively formed and safely used and will be effective under the circumstances described in view of the dual action of the pressure surge and injection of the caustic material which occur when the collapsible container is collapsed when in communication with the stopped up drain. It will occur to those skilled in the art that the present method and device will work very well when submerged in water in a sink bowl in communication with a stopped up drain associated therewith.

Although but one embodiment of the present invention has been illustrated and described, it will be apparent to those skilled in the art that various changes and modifications may be made therein without departing from the spirit of the invention and having thus described my invention what I claim is:

1. A collapsible container for a caustic material useful in opening a stopped up drain, said collapsible container having a tubular body with a closed end and an open end, a sealing disc secured to said open end and a cap-like closure removably positioned thereover and mechanically engaged on said container, the body of said container comprising a bellows-like configuration movable from a first position wherein said bellows is extended to a second position where said bellows is contracted and means on said open end of said container for registry with the open end of a drain pipe.

2. The container of claim 1 and wherein the means on the container for registry with the open end of a drain pipe comprises an enlarged collar for forming a seal with said open end of said drain pipe.

3. The container of claim 1 and wherein the tubular body is cylindrical.

4. The container of claim 1 and wherein the open end of the container defines a throat and an exterior thread pattern is formed thereon and said cap-like closure is internally threaded for registry with said thread pattern on said throat.

5. The container of claim 1 and wherein said sealing disc is formed of a material consumable by said caustic material in an aqueous solution.

6. The container of claim 1 and wherein said sealing disc is formed of aluminum.

* * * * *